United States Patent [19]

Calderaro

[11] 4,168,052

[45] Sep. 18, 1979

[54] FOLDABLE BEARER STRUCTURE FOR INNER MOULDS

[76] Inventor: Dante R. Calderaro, Avellaneda St. 356, 1846 Adrogué (B.A.), Argentina

[21] Appl. No.: 862,567

[22] Filed: Dec. 20, 1977

[30] Foreign Application Priority Data

Dec. 20, 1976 [AR] Argentina ..... 265917

[51] Int. Cl.[2] ..... E04G 17/14

[52] U.S. Cl. ..... 249/188; 182/152; 249/210

[58] Field of Search ..... 248/167; 182/152, 156; 56/66, 68, 69, 70; 249/27, 185, 210, 188

[56] References Cited

U.S. PATENT DOCUMENTS

| | | | |
|---|---|---|---|
| 2,835,931 | 5/1958 | Sterkin | 52/70 |
| 3,280,796 | 10/1966 | Hatcher | 52/70 |
| 3,847,341 | 11/1974 | Stickler, Jr. | 249/27 |
| 3,926,403 | 12/1975 | Markewitz et al. | 249/27 |
| 4,035,964 | 7/1977 | Robinson | 52/66 |

*Primary Examiner*—John McQuade

*Attorney, Agent, or Firm*—Browdy and Neimark

[57] ABSTRACT

A foldable bearing trihedron for inner moulding surfaces comprises a triangular portal having a right leg with a horizontal beam at the upper end thereof and a diagonal stay at its lower end, right angle triangles being hinged to the horizontal beam, and the right leg having rectangles hinged thereto.

6 Claims, 6 Drawing Figures

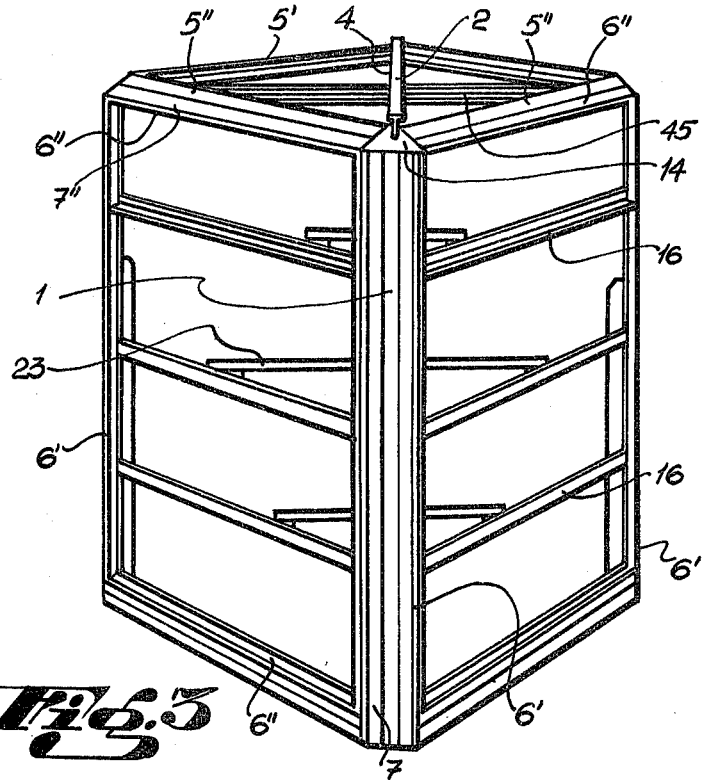
Fig. 3
Fig. 4
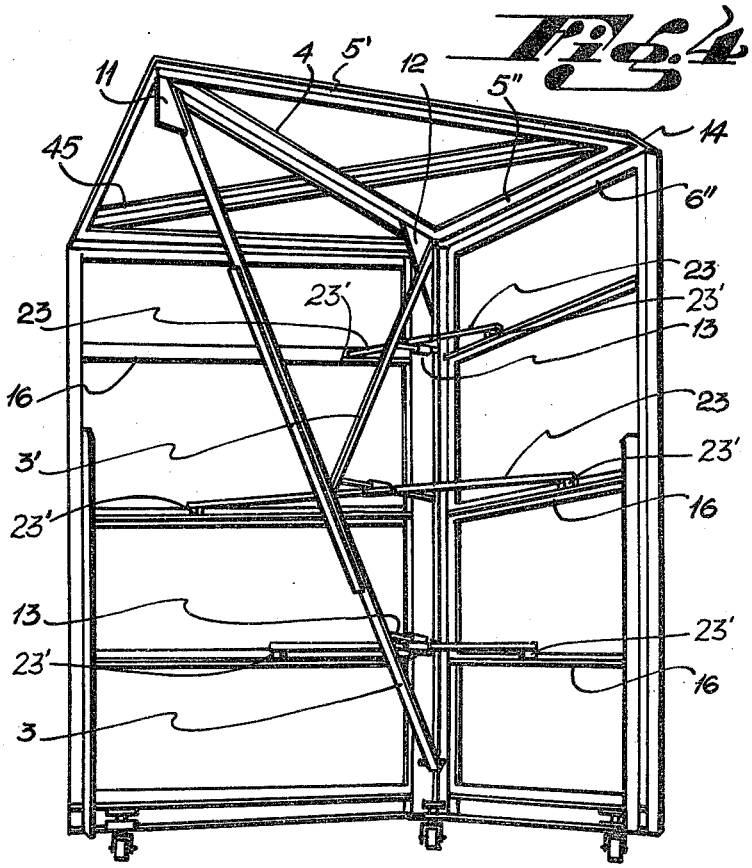

FOLDABLE BEARER STRUCTURE FOR INNER MOULDS

BACKGROUND OF THE INVENTION

The present invention is related to a foldable bearing trihedron for inner moulding surfaces.

Moulds, including foldable moulds, for inner and outer surfaces are known. Their cost and complexity, as well as their weight, are, as a rule, so high as to justify their use only for sizable constructions to be carried out on one and the same spot, with the aid of special and very high cranes, and highly specialized personnel.

The essence of this invention resides in that a foldable trihedron is provided, the cost, weight and simplicity of handling and transportation of which permit dispensing with cranes, employing personnel with an average skills, and using it in large-scale constructions as well as for small buildings, including those with only one room, located at far-off sites, to which it may be carried on current trucks. Thanks to the trihedron according to this invention the following features are permitted:

(1) the use of light-weight moulds (which do not require cranes);

(2) folding them so that when closed they form a "parcel" of reduced dimensions;

(3) that once they are in position (interconnected) their vertical and horizontal wings may be "spread out" without "falling", whereby it is possible to center minimum insulations in walls with a reduced thickness. Such is the case of the outer walls of individual and independent homes. Moreover, they allow applying to their surface coatings, hot and cold water frames, windows including their frames, electricity tubings, blocks, and such like, once they are set and levelled but before pouring concrete.

(4) building simultaneously in one single operation:

(a) the roof slabs;

(b) the structural columns according to an arbitrary module;

(c) the "non-bearing" walls or partitions;

(d) the beams (in either of the two dimensions);

(e) also (wherever necessary) the "bearing" partitions, i.e. with structural iron.

In principle, these moulds are of the kind which provide in tridimensional form the cubicle of one or several rooms. Each inner mould is one fourth (¼) of the said cubicle.

Each foldable trihedron projects through a groove of reduced dimensions. This opening may be provided in the vertical walls as well as in the slabs (in order to hoist them up to an upper floor).

The horizontal wings, which are triangular, when lowered move away from the surface of the vertical wings. This results in:

(a) larger dimensions of resistant structures of the vertical wings (cross members) and therefore a larger thickness of the partitions;

(b) less danger of accidents to the workmen;

(c) a free inner space, in the mounted equipment which expedites the operations of mounting, applying meshes and mould removal.

The inner moulds reach their working position at 90° (45° on each side of the rigid portal, referred to the vertical wings). This ensures a great security of handling and displacements. The vertical wings of the inner moulds meet at an intermediate point of the span of the walls, i.e. there is no interruption in the module which is adopted in the folded sheet.

The maximum stresses of the concrete upon being poured into the moulds, are directed towards the *columns,* of which *each inner module constitutes one fourth.* The structural sense of the rigid portal is directed on the bias and all four are convergent towards a central keypoint which may or may not be propped up.

The vertical as well as the horizontal wings of the inner moulds form planes for receiving modulated sheets in a vertical as well as in a horizontal sense which, apart from making the frame rigid, may provide the walls figures which, apart from being resistant, form embossments, planes, grooves, etc. and decorate them in a utilitarian manner.

By reducing the diagonal stay in the inner mould it is possible to insert complementary vertical moulds, thus forming additional divisions. This permits building 100% of the thick constructions, including the partitions of bathrooms, kitchens, etc. In these inner moulds, the "neck" of the ceiling is formed between the horizontal and the vertical wings. The shape adopted by this sheet aids in the opening movement of both the vertical and the horizontal sheet. At the center of convergence of the inner moulds hollow spaces are formed for built-in illumination or zenith lights. Lastly, this system permits also building in height. To this end, the section of the columns and partitions decreases in proportion with the increase of the height.

Basically, such moulds are rolling trihedrons, i.e. they form one quarter of the slab and part of the partitions concurrent to the column (or pillar), the latter being located at the intersection or the vertical planes and the beams, at the meeting point of the three planes.

Thus the rigid portal is located between two triangular wings which upon being lowered move away from the vertical wings procuring:

(a) more space for reinforcements in vertical wings;

(b) more space inside the poured cubicle;

(c) better stability of the module opening from 0° to 90° around the horizontal portion of the rigid portal.

In these trihedron modules the center of gravity is very well located and results in considerable security to this mould during transportaion and positioning.

Between the vertical and horizontal wings a neck is formed with the following purpose:

(a) to give a better finish to the compression portion of the beams;

(b) to give a better finish to the ceiling.

Once the modules are interconnected (the inner modules with the inner ones or the inner modules with the outer ones), the sheets may be readily opened, whereby it is possible to carry out with ease the installation or decoration tasks. The rigid core of the inner trihedrons are bisectors of the right angles of the cubicles.

Upon finishing one part, the folded trihedrons may project through grooves in the partition and the slabs providing utilitarian openings or windows. In order to be hoisted up, they are folded and as soon as they are in place, they can be again unfolded.

The use of such groups of trihedrons may avoid the need for application of plaster, both rough and fine, and the usual finish.

Unlike other moulds, these bring about an appreciable economy or iron, inasmuch as the partitions are not bearer elements but merely simple delimitations of rooms, and it is possible to leave large spans between one column and the next and beams (i.e. a structure made up by columns and beams, with complete freedom of partitioning which may be made not only with the aid of concrete but also of other materials as, for instance, glass, wood panels, curtains, etc.). The considerable economy or iron is also due to the following facts: the columns and beams are mounted in accordance with traditional calculations, whereby, as the partitions are not bearer elements, the obligation of reinforcing them does not apply. The columns are propped up by concurrent partitions, so that the removal of moulds from the assembly may be carried out without structural problems.

These modules comprise frames having appropriate strength and may be completed by different types of moulding surfaces; for instance, surfaces defined by folded or press-formed sheets, glass, wood, compressed sheets, i.e. with receiving frames, including openings as, for instance, windows, doors and such like.

At the corners it is possible to build: (1) a rectangular overhang; (2) a beveled overhang; (3) an interrupted overhang; (4) partial balconies; (5) balconies constituting loggias.

By inserting sheets between the trihedrons and the outer moulds, it is possible to obtain spaces for equipment.

The architecture project may be carried out in the shape of squares, of the letter T, of a cross, staggered or rectangular using moulds of the present invention.

Due to the fact that the modules can be opened, it is possible to proceed with utmost security to the insertion of insulations at the exact spot (the case of a 1-cm-thick "Telgopor" sheet exactly in the middle of a wall having a thickness of only 10 cm, whereby problems of heat transmission are avoided and consequently the habitability norms required by the competent authorites are complied with.

An exemplary embodiment of a bearing trihedron for inner moulding surfaces according to the invention is characterized by including a triangular portal constituted by a right leg, at the upper end of which is fixed one end of a horizontal beam, the other end of which is fixed to one end of a diagonal stay having its other end fixed to the lower end of the said right leg. On either side of the horizontal beam are hinged, by means of their hypothenuses, right-angled triangles having equal legs. To either adjacent side of the right leg are hinged, by means of their larger sides, a rectangle, the smaller sides of which are equal to the legs of the triangles. Fixed near the edge opposite the one to which the adjacent sides of the right leg concur, there are wood frames which are rectangular, coplanar, parallel and near the diametrical plane of the right leg perpendicular to the horizontal beam, the total width of the wood frames being at the most equal to the width of the face of the opposing column.

BRIEF DESCRIPTION OF THE DRAWINGS

For a better understanding of the nature of this invention and the form in which the same can be put into practice, a preferred embodiment of the invention will now be described with the aid of the appended drawings. It is to be understood clearly that this preferred embodiment is given solely by way of example and does not in any way limit the scope of the invention as defined in the foregoing paragraph.

In the appended drawings, where the same reference numbers correspond to the same parts:

FIG. 3 shows the unfolded trihedron, seen from the side to which the poured concrete will be applied;

FIG. 4 is analogous to the foregoing embodiment, however with the trihedron seen from its inside, unfolded and ready for coating by the moulding surfaces;

As may be appreciated from the drawings, the foldable bearing trihedron according to this invention is constituted by a rigid portal, formed by the right leg 1 which, at its upper end, is connected with a horizontal beam 2. One end of the horizontal beam 2 is connected with the upper end of a diagonal stay 3, the lower end of which is connected with the lower end of the right leg 1. As may be appreciated from FIG. 3, the outer edge of the right leg 1 is beveled, as best seen in FIG. 3, and to either side of the bevel is fixed one wood frame 7 forming a plane corresponding to the side of a concrete column to be moulded.

Figure 2:
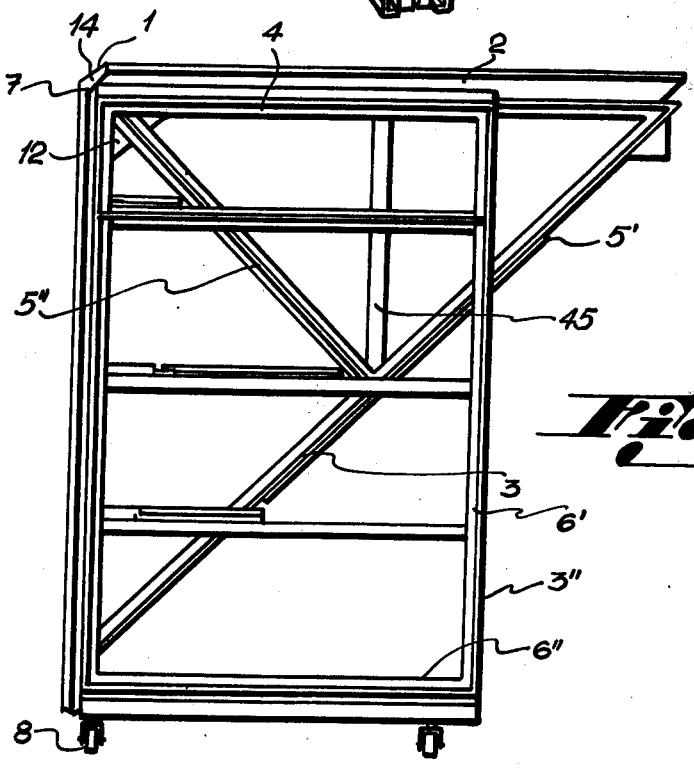
FIG. 2 shows the same folded trihedron, in a lateral view.

To the edge of the right leg 1, opposite the beveled one, are hinged corresponding rectangles having larger sides 6' and smaller sides 6''. These rectangles 6'-6'' are formed by their sides and carry, transversely, cross members 16 parallel to their smaller sides 6''. Between the sides 6'-6'' and the cross members 16 there are planes which permit the positioning of sheets, decorated or not, against the surfaces of which poured concrete is applied in known manner. The articulation of the rectangles 6'-6'' to the right leg is carried out by means of hinges such as those indicated by reference number 10. The lower smaller sides 6'' are adapted to be provided with casters 8 in the same manner as the lower end of the right leg 1 (FIG. 2). The smaller sides 6'' are provided with a bevel, as may be appreciated in FIGS. 5 and 6.

To the horizontal beam 2 is jointed, by means of hinges or such like, on each side thereof one hypothenuse 4 of right-angled triangles having equal legs 5'-5''. The legs 5'' are beveled so that their corresponding surfaces are coplanar with the above mentioned wood frames 7, connected with the smaller upper sides of the rectangles 6'-6'' hinged onto the right leg 1. It is obvious that the legs 5'-5'' have the same length as the smaller sides 6''. The legs 5' are secured to the juncture of the horizontal beam 2 with the diagonal stay 3, where a sheet 11 is provided (FIG. 4), perpendicular to the floor on which bear the casters 8 the casters 8 being carried by the lower shorter sides 6'' of the rectangle. Furthermore, the triangles are provided with a reinforcement member 45 and with planes adapted for receiving inner moulding surfaces such as the rectangles 6'–6'' the reinforcing member 45 being shown in FIG. 2.

The diagonal stay 3 is fixed, at its center, to a reinforcement bar 3' (FIG. 4) which is fixed, at its other end, to a triangular plate 12 reinforcing the juncture between the right leg 1 and the horizontal beam 2.

Lastly, the beams 16, at the same level as the two rectangles 6'-6'', are interconnected by means of small tie bars 23, hinged at 23' to each other and in the same way the diagonal stay 3 and its reinforcement bar 3' are connected to the right leg 1 by means of small tie bars 13.

Figure 1:
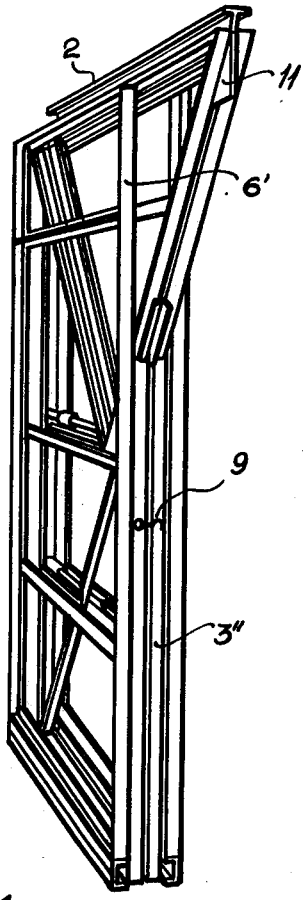
FIG. 1 shows, in perspective, the trihedron according to this invention, folded and ready for transportation.

The trihedron operation in accordance with this invention is carried to the site folded as shown in FIGS. 1 and 2.

Figure 5:
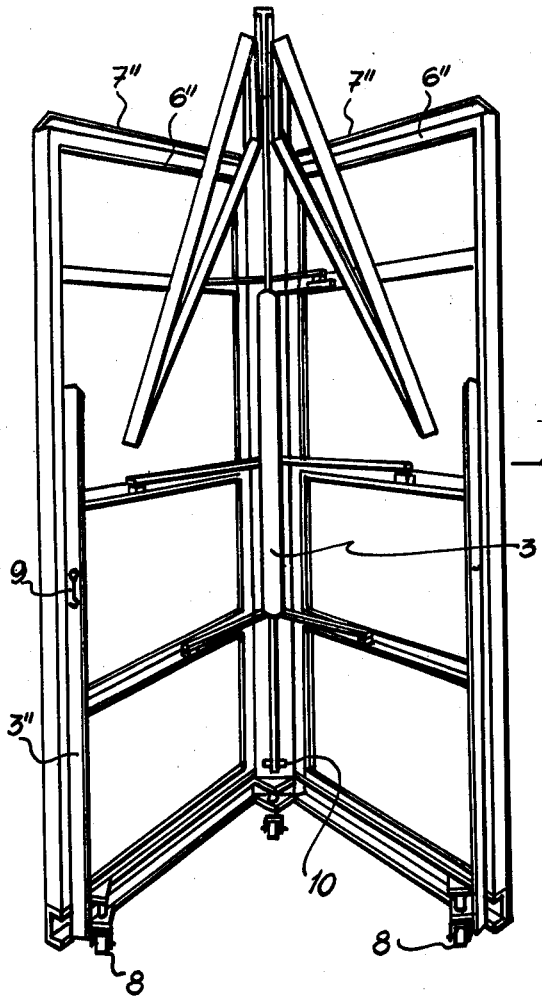
FIG. 5 shows, in perspective, the trihedron of FIG. 4 in the first folding step.
Figure 6:
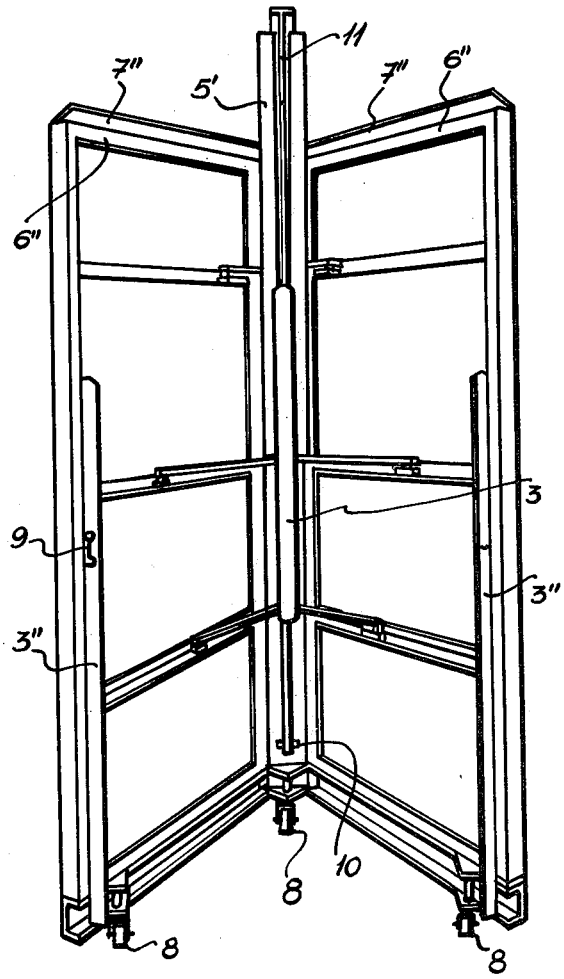
FIG. 6 shows, in perspective, the trihedron of FIG. 5 in the folding step preceding the final one, where it will have the aspect shown in FIG. 1.

There it is unfolded and positioned as required and its shape is shown in FIGS. 3 and 4 (of course, after fitting into place on the planes the sheets with their moulding surfaces). The unfolding is carried out by going through the steps of the following operation, but in reversed sequence as described hereinafter: (1) the triangles 4–5 are folded back in downward direction by rotating them around their hypothenuses as shown in FIG. 5. It should be noted that in the course of this operation they move away from the rectangles 6'-6'', whereby the operation is easier to carry out and allows the correction of possible alignment errors so that they be positioned as shown in FIG. 6; (2) the rectangles 6'-6'' and closed as shown in FIGS. 5 and 6 so that they assembly assume to shape shown in FIG. 1 including the closing of hook 9, the hook 9 being shown in FIGS. 5 and 6 in its open position.

A group of three or four workmen may now roll the trihedron to a truck and, even, hoist it up and load it onto same, inasmuch as its weight as a practical matter is around 200 kilos. It is also possible to provide a kind of wagon permitting its transportation with only two workmen, one pulling it and the other one taking care that it does not overturn.

Of course, the trihedron according to this invention should be used in combination with outer moulds so as to be able to pour between them concrete in the usual manner.

It is also possible to carry out in the embodiment as described numerous modifications of detail such a providing the diagonal stay 3 with the bar 3' reinforcing it. Reinforcement bars 3'' connected with the front sides 6' of the rectangles 6'-6'' are provided, beveling, at 14, the upper end of the right leg 1, etc.; however all such modifications fall within the scope of this invention as defined in the following claims.

What I claim is:

1. A foldable bearing trihedron for inner moulding surfaces, the trihedron comprising, in combination, a triangular portal constituted by a right leg having a first end and a second end, said first end of which is fixed to one end of a horizontal beam, said second end of the horizontal beam is fixed to a first end of a diagonal stay, the second end of the diagonal stay fixed to said second end of said right leg; right-angle triangular shaped structures having equal legs and respective hypothenuse members hinged thereat to said horizontal beam; rectangular shaped structures hinged at each side of said right leg along their respective longer sides, the smaller sides of said rectangular shaped structures being equal in length to said legs of said triangular shaped structures; wood frames fixed near opposite sides of the right leg, said wood frames being rectangular, coplanar, parallel and perpendicular to said horizontal beam.

2. A foldable trihedron as set forth in claim 1, including a reinforcement plate carried by said right leg at its first end at a junction with said beam.

3. A foldable trihedron as set forth in claim 1, including reinforcement means including tie bars connecting said diagonal stay to said right leg.

4. A foldable trihedron as set forth in claim 1, wherein said right-angled triangular and rectangular shaped structures define planes and are adapted for supporting members constituting moulding surfaces.

5. A foldable trihedron as set forth in claim 1, including reinforcement bars carried by said triangular shaped structures.

6. A foldable trihedron as set forth in claim 1, including beams carried by said rectangular shaped structures parallel to their smaller sides.

* * * * *